US006360960B1

(12) United States Patent
Nally, Jr. et al.

(10) Patent No.: US 6,360,960 B1
(45) Date of Patent: Mar. 26, 2002

(54) FUEL INJECTOR SAC VOLUME REDUCER

(75) Inventors: John F. Nally, Jr., Williamsburg; William A. Peterson, Jr., Smithfield, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/572,098

(22) Filed: May 17, 2000

(51) Int. Cl.[7] ..... F02D 1/06; B05B 1/30; F02M 51/00

(52) U.S. Cl. ..... 239/5; 239/585.1; 239/585.4; 239/585.5

(58) Field of Search ..... 239/5, 585.1, 585.4, 239/585.5, 533.3, 533.11, 533.12, 596; 251/333, 129.21

(56) References Cited

U.S. PATENT DOCUMENTS

| | | | | |
|---|---|---|---|---|
| 4,475,690 A | * | 10/1984 | Hascher-Reichl et al. | 239/585.3 |
| 4,585,174 A | * | 4/1986 | Knapp | 239/585.1 |
| 4,678,160 A | * | 7/1987 | Yamada et al. | 239/585.3 |
| 4,771,984 A | * | 9/1988 | Szablewski et al. | 239/533.11 |
| 4,934,605 A | | 6/1990 | Hans et al. | |
| 5,221,046 A | | 6/1993 | Timmer | |
| 5,244,154 A | * | 9/1993 | Buchholz et al. | 239/533.12 |
| 5,273,215 A | * | 12/1993 | Hans et al. | 239/585.1 |
| 5,484,108 A | | 1/1996 | Nally | |
| 5,732,889 A | | 3/1998 | Sasao | |
| 5,746,376 A | | 5/1998 | Romann et al. | |
| 5,762,272 A | * | 6/1998 | Tani et al. | 239/585.4 |
| 5,765,750 A | | 6/1998 | Pace et al. | |
| 5,772,124 A | | 6/1998 | Tamaki et al. | 239/533.12 |
| 5,785,254 A | | 7/1998 | Zimmermann et al. | |
| 5,881,957 A | | 3/1999 | Mizuno et al. | |

FOREIGN PATENT DOCUMENTS

| | | |
|---|---|---|
| GB | 2 198 785 | 6/1988 |
| WO | WO 92/19859 | 11/1992 |

* cited by examiner

*Primary Examiner*—David A. Scherbel
*Assistant Examiner*—Davis Hwu

(57) ABSTRACT

A fuel injector for use in a fuel injection system of an internal combustion engine is disclosed. The fuel injector includes a body, a needle, and a metering orifice. The body has a longitudinal axis and a valve seat. The valve seat has a beveled annular surface and a central opening therethrough. The central opening is formed by a generally cylindrical wall. The needle includes a first portion having a first cross sectional area and a second portion having a second cross-sectional area. The second portion includes a needle end face which extends generally perpendicular to the longitudinal axis. The needle is reciprocally located within the body along the longitudinal axis and is biased against the valve seat. The metering orifice is connected to a downstream end of the valve body. A fuel sac is generally formed by the metering orifice, the needle end face, and the cylindrical wall. A projection extends into the fuel sac, reducing a volume of the fuel sac. The projection extends from at least one of the needle end face and the metering orifice. A method of reducing unmetered fuel in a fuel injector by reducing sac volume is also disclosed.

25 Claims, 6 Drawing Sheets

FUEL INJECTOR SAC VOLUME REDUCER

FIELD OF THE INVENTION

This invention relates to fuel injectors, and more particularly, to fuel injectors having a sac volume that minimizes residual fuel after metering.

BACKGROUND OF THE INVENTION

Fuel injectors are commonly employed in internal combustion engines to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The precise metering and atomization of the fuel reduces combustion emissions and increases the fuel efficiency of the engine.

An electromagnetic fuel injector typically utilizes a solenoid assembly to supply an actuating force to a fuel metering valve. Typically, the fuel metering valve is a plunger style needle valve which reciprocates between a closed position, where the needle is seated in a valve seat to prevent fuel from escaping through a metering orifice into the combustion chamber, and an open position, where the needle is lifted from the valve seat, allowing fuel to discharge through the metering orifice for introduction into the combustion chamber.

Typically, a volumetric chamber or sac exists between the discharge tip of the needle and the metering orifice. Upon seating of the needle on the valve seat, a volume of fuel remains within the sac and tends to drain through openings in the metering orifice after the metered fuel has already been discharged through the metering orifice, typically during low manifold pressure, high injector tip temperature operating conditions. This discharge produces rich combustion which generates unwanted exhaust emissions and reduces the fuel efficiency of the engine. Some of the fuel, however, remains in the sac which vaporizes and causes rich/lean shifts and hot start issues which are undesirable.

It would be beneficial to develop a fuel injector in which the sac volume is minimized, reducing the amount of unmetered fuel in the sac after metering.

SUMMARY OF THE INVENTION

Briefly, the present invention provides a fuel injector for use in a fuel injection system of an internal combustion engine. The fuel injector includes a valve body, a valve seat, a metering orifice, a needle and a volume. The body has an inlet, an outlet and a longitudinal axis extending therethrough. The valve seat is located within the body and disposed proximate the outlet. The valve seat includes a valve seat orifice and a sealing surface surrounding the orifice. The metering orifice is connected to the body downstream of the valve seat. The needle is reciprocally located within the body along the longitudinal axis between a first position wherein the needle is displaced from the valve seat, allowing fuel flow past the needle, and a second position wherein the needle is biased against the valve seat, precluding fuel flow past the needle. The needle includes a first portion having a first cross-sectional area and a second portion having a second cross-sectional area. The second cross-sectional area is larger than the first cross-sectional area. The second portion includes an end face extending generally perpendicular to the longitudinal axis. The end face is located upstream of the valve seat orifice. The volume is generally defined by the metering orifice, the end face and the valve seat orifice when the needle is in the second position.

The present invention also provides a fuel injector for use in a fuel injection system of an internal combustion engine. The fuel injector comprises a valve body, a valve seat, a metering orifice, a needle, and a volume. The body has an inlet, an outlet and a longitudinal axis extending therethrough. The valve seat is located within the body and disposed proximate the outlet. The valve seat includes a valve seat orifice and a sealing surface surrounding the valve seat orifice. The metering orifice is connected to the body downstream of the valve seat. The needle is reciprocally located within the body along the longitudinal axis between a first position wherein the needle is displaced from the valve seat, allowing fuel flow past the needle, and a second position wherein the needle is biased against the valve seat, precluding fuel flow past the needle. The needle includes a first portion having a first cross-sectional area and a second portion having a second cross-sectional area. The second portion includes an end face extending generally perpendicular to the longitudinal axis. The volume is generally defined by the metering orifice, the end face and the valve seat orifice when the needle is in the second position. The metering orifice is spaced from the end face by a distance of between 100 microns and 250 microns.

The present invention also provides a method of reducing unmetered fuel in a fuel injector. The fuel injector including a valve seat, a needle, a volume, and a metering orifice. The method comprises the steps of providing a fuel injector; providing pressurized fuel to the fuel injector; opening the fuel injector by moving the needle off of the valve seat, thereby allowing the pressurized fuel to flow past the needle and the valve seat and through the volume and the metering orifice for ejection from the fuel injector; and closing the fuel injector by seating the needle against the valve seat, reducing the volume and fuel within the volume.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain features of the invention. In the drawing.

DETAILED DESCRIPTION OF THE PREFERRED EMBODIMENTS

Figure 1:
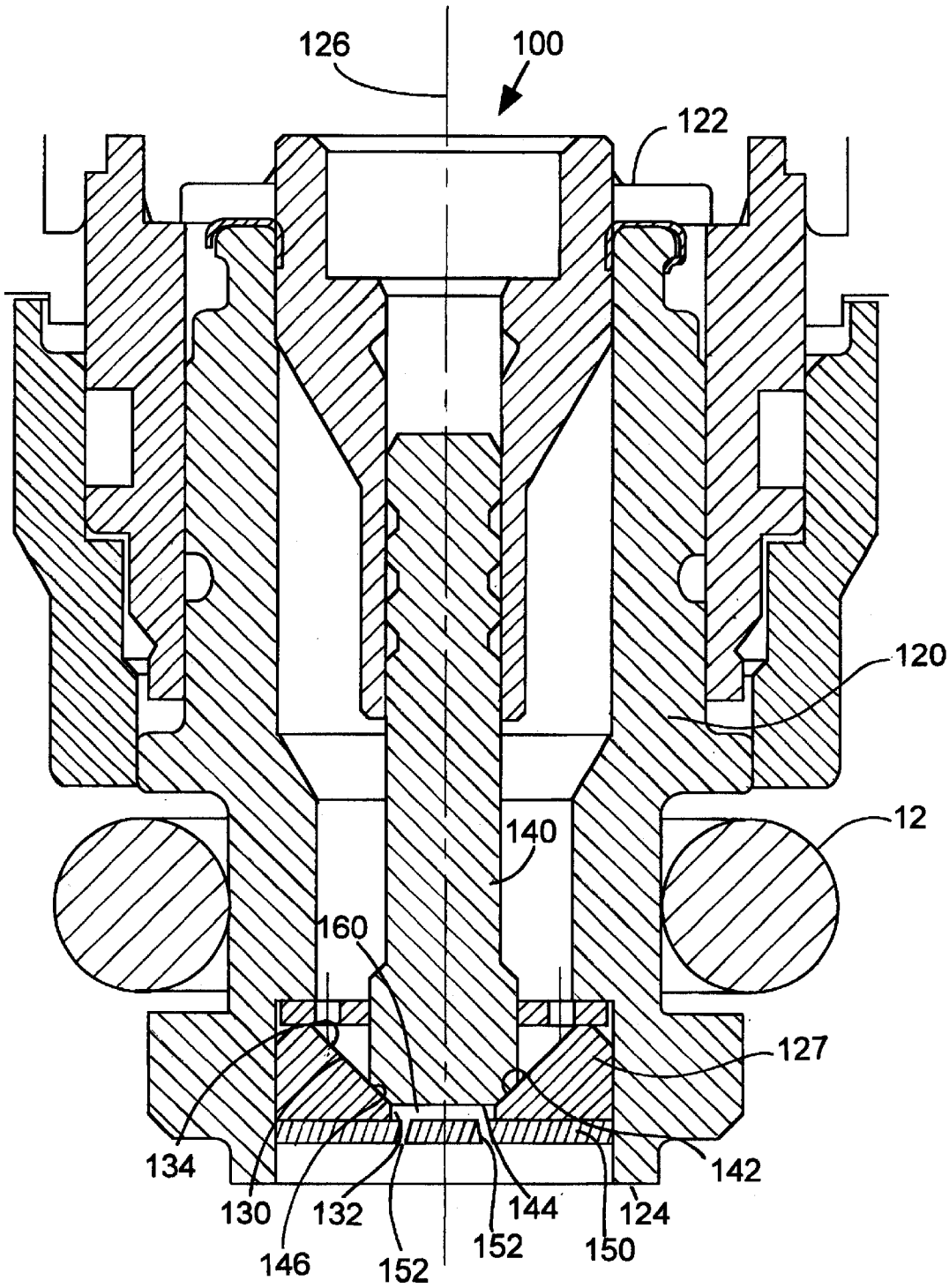
FIG. 1 is a side view, in section, of a discharge end of a fuel injector according to a first embodiment of the present invention with a needle in a closed position.

In the drawings, like numerals are used to indicate like elements throughout. FIG. 1 shows a sectional view of a first embodiment of a fuel injector 100 having a body 120 and a needle 140. The body 120 includes a valve seat 127 having a central valve seat orifice 132. The valve seat 127 includes a beveled seat surface 134 which slopes radially inwardly and downwardly toward the central orifice 132 oblique to a longitudinal axis 126 of the body 120. The words "inwardly" and "outwardly" refer to directions towards and away from, respectively, the longitudinal axis of each embodiment of the injector in accordance with the present invention, and designated parts thereof.

The needle 140 reciprocates between an open position and a closed position along the longitudinal axis 126 of the body 120. The needle 140 includes a generally spherical tip 142 which includes a generally planar end face 144. However, those skilled in the art will recognize that the end face 144 need not be planar. The end face 144 is preferably generally perpendicular to the longitudinal axis 126. In both the open and closed position, the end face 144 is located upstream of the valve seat orifice 132. The spherical tip 142 matches the beveled seat surface 134 of the valve seat 130 when the needle 140 is in a closed position, as shown in FIG. 1, such that a valve contact face 146 of the spherical tip 142 engages the beveled valve seat surface 134, forming a generally line contact seal between the spherical tip 142 and the beveled seat surface 134. A metering orifice 150 is located at a downstream location of the body 120, approximate to, but spaced from, the end face 144. The words "upstream" and "downstream" designate flow directions in the drawings to which reference is made. The upstream side is toward the top of each drawing and the downstream side is toward the bottom of each drawing. The metering orifice 150 includes at least one, and preferably several, metering openings 152 which are radially spaced from the longitudinal axis 126 of the body 120. Preferably, in the closed position, the top of the metering orifice 150 and the end face 144 are spaced from each other by between approximately 50 microns and 250 microns.

When the needle 140 is in an open position, the valve contact face 146 is raised above and separated from the beveled seat surface 134, forming an annular opening therebetween, allowing pressurized fuel to flow therethrough and through the openings 152 in the metering orifice 150 to a combustion chamber (not shown) for combustion. Upon closing of the needle 140 so that the valve contact face 146 engages the beveled seat surface 134, the flow of fuel through the injector 100 is cut off.

When the needle 140 is in a closed position, cutting off the flow of metered fuel, a volume or sac 160 is formed between the end face 144, the metering orifice 150, and the sides of the valve seat 130. The sac 160 tends to retain a volume of fuel in the sac which vaporizes and causes rich/lean shifts and hot start issues which are undesirable.

Figure 2:
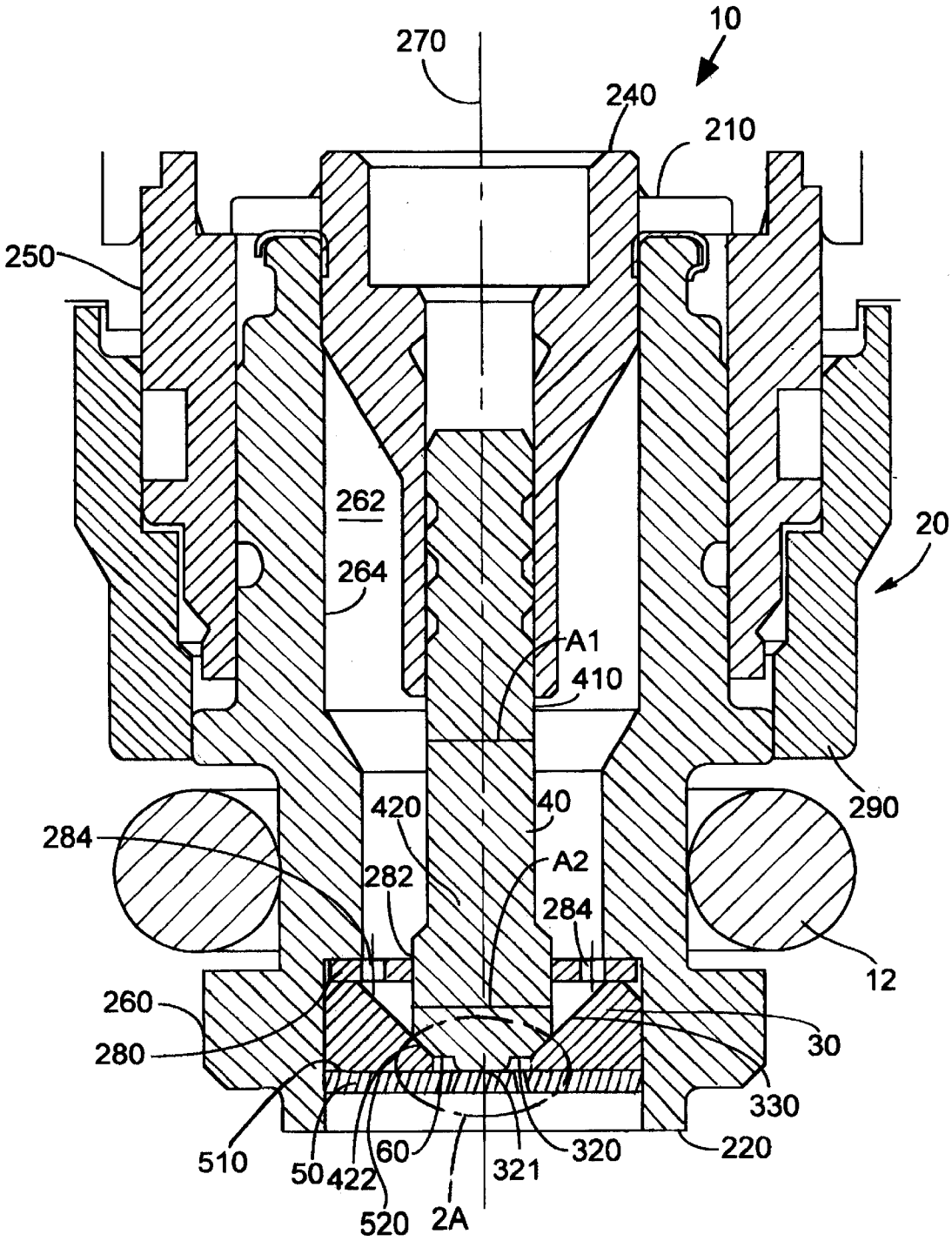
FIG. 2 is a side view, in section, of a discharge end of a fuel injector according to a second embodiment of the present invention with a needle in a closed position.
Figure 3:
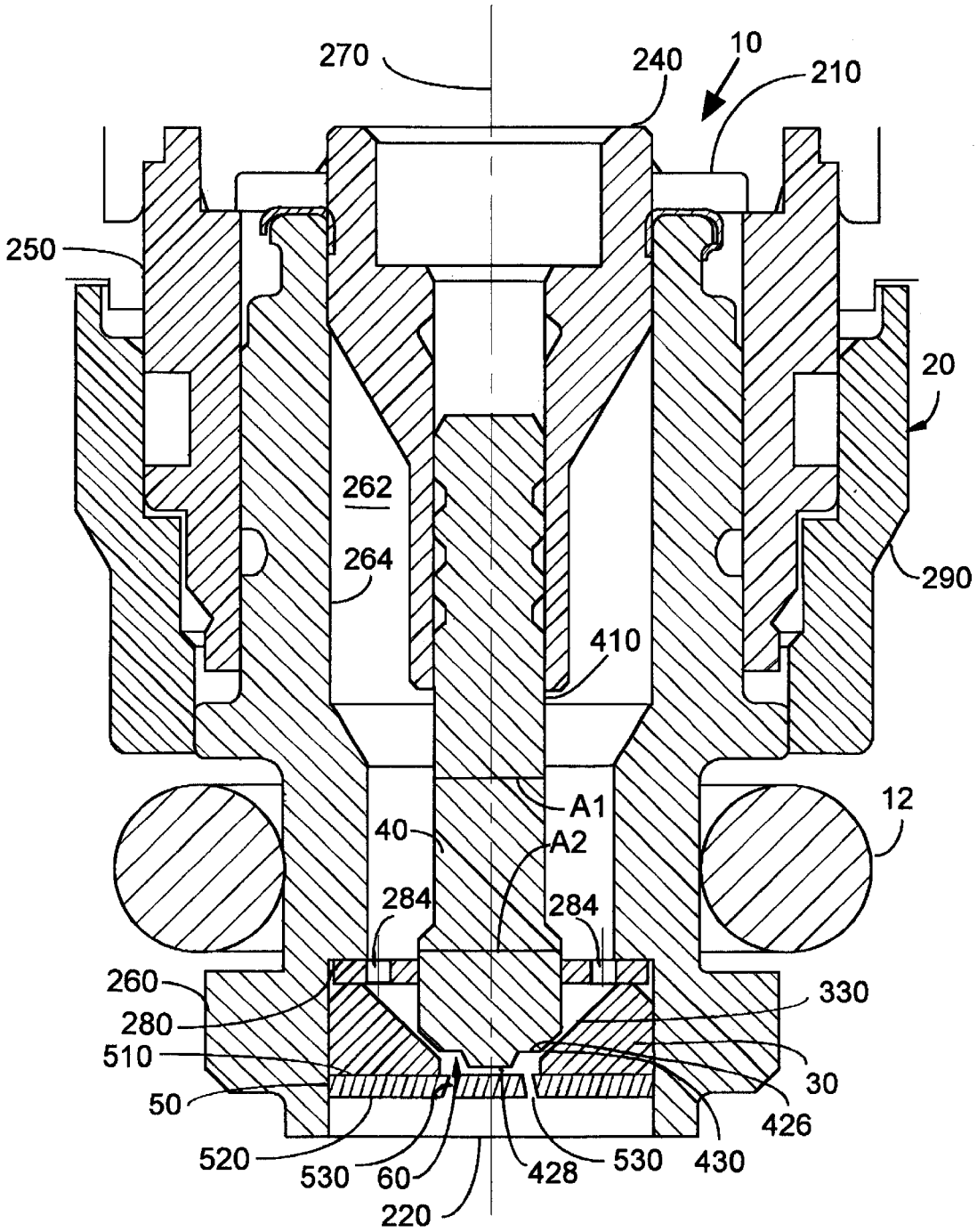
FIG. 3 is a side view, in section, of the discharge end of the fuel injector according to the second embodiment of the present invention with the needle in an open position.
Figure 4:
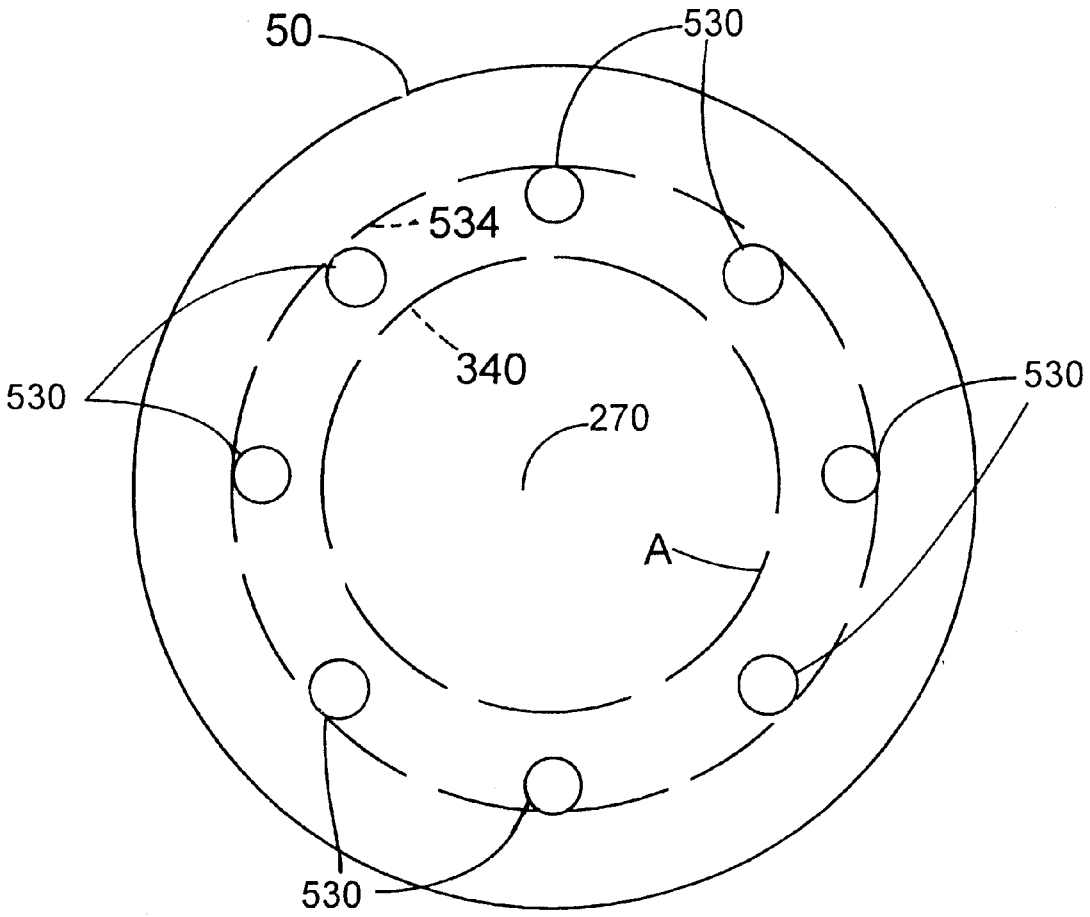
FIG. 4 is a top plan view of a metering orifice used in the second embodiment.

A second embodiment of the present invention, shown in FIGS. 2–4, is a fuel injector 10 for use in a fuel injection system of an internal combustion engine. The injector 10 includes a body 20, a valve seat 30, a needle 40 having a projection 428, a generally planar fuel metering orifice 50, and a volume or sac 60. Details of the operation of the fuel injector 10 in relation to the operation of the internal combustion engine (not shown) are well known and will not be described in detail herein, except as the operation relates to the present invention. Although the present invention is generally directed to injector valves for internal combustion engines, those skilled in the art will recognize from present disclosure that the present invention can be adapted for other applications in which precise metering of fluids is desired or required.

Figure 2A:
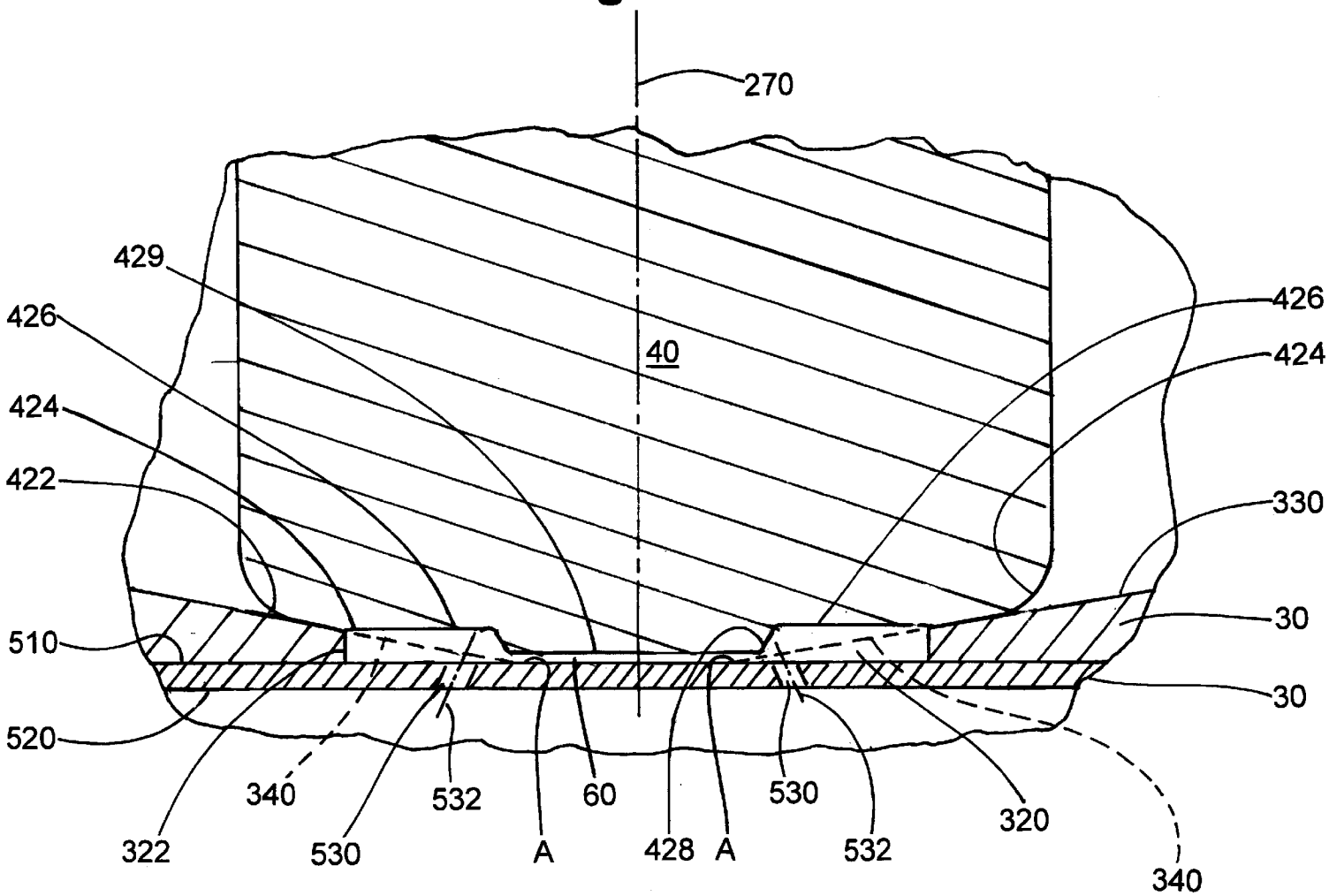
FIG. 2A is an enlarged view of the discharge end of the fuel injector of FIG. 2.

The body 20 has an upstream or inlet end 210 and a downstream or outlet end 220. The body 20 includes an armature 240 as shown in FIGS. 2, 2A. The needle 40 is connected to the armature 240. An electromagnetic coil (not shown) located within the body 20 is selectively energized and deenergized to reciprocate the armature 240 and the needle 40 within the body 20. The body 20 further includes a body shell 250 which is constructed from ferromagnetic material and which forms part of a magnetic circuit which operates the magnetic coil. The body shell 250 partially surrounds a valve body 260 which includes a valve body chamber 262. The valve body chamber 262 extends through a central longitudinal portion of the body 20 along a longitudinal axis 270 extending therethrough and is formed by an interior valve body wall 264. A needle guide 280 having a central needle guide opening 282 and a plurality of radially spaced fuel flow openings 284 is located within the valve body chamber 262 proximate to the downstream end 220 of the body 20. The needle guide 280 assists in maintaining reciprocation of the needle 40 along the longitudinal axis 270. An overmold 290 constructed of a dielectric material, preferably a plastic or other suitable material, encompasses the body shell 250. An o-ring 12 is located around the outer circumference of the valve body 260 to seat the injector 10 in an internal combustion engine (not shown).

The valve seat 30 is located within the valve body chamber 262 proximate to the outlet end 220 between the needle guide 280 and the discharge end 220. The valve seat 30 includes a passage or orifice 320 which extends generally along the longitudinal axis 270 of the body 20 and is formed by a generally cylindrical wall 322. Preferably a center 321 of the orifice 320 is on the longitudinal axis 270. The valve seat 30 also includes a beveled sealing surface 330 which surrounds the orifice 320 and tapers radially downward and inward toward the orifice 320 such that the sealing surface 330 is oblique to the longitudinal axis 270.

Although not shown, those skilled in the art will recognize that an o-ring can seal the interface between the valve seat 30 and the valve body 260. Although this is a preferred method of sealing the interface, those skilled in the art will also recognize that the o-ring may be omitted, and a hermetic weld (not shown) can be used to seal the interface.

The needle 40 is reciprocally located within the valve body chamber 262 generally along the longitudinal axis 270 of the body 20. The needle 40 is reciprocable between a first, or open, position wherein the needle 40 is displaced from the valve seat 30 (as shown in FIG. 3), allowing pressurized fuel to flow downstream past the needle 40, and a second, or closed, position wherein the needle 40 is biased against the valve seat 30 (as shown in FIGS. 2, 2A) by a biasing element (not shown), preferably a spring, precluding fuel flow past the needle 40.

Referring now to FIGS. 2, 2A, the needle 40 includes a first portion 410 which has a first cross-sectional area A1 and a second portion 420 which has a second cross-sectional area A2. The second portion 420 includes a generally spherical contact face 422 which is sized to sealingly engage the beveled valve sealing surface 330 when the needle 40 is in the closed position. The spherical contact face 422 engages the beveled valve sealing surface 330 to provide a generally line contact therebetween. A rounded surface 424, shown in enlarged FIG. 2A, connects the contact face 422 with a planar end face 426 located at a downstream tip of the needle 40. The end face 426 is preferably generally perpendicular to the longitudinal axis 270 of the body 20. A projection 428 extends from the end face 426 toward the discharge end 220 of the body 20. Preferably, the projection 428 is generally a circular cylinder in shape and has a mid-point on the longitudinal axis 270 of the body 20, although those skilled in the art will recognize that the projection 428 can be other shapes as well. The projection 428 includes a generally planar end surface 429 which is preferably generally perpendicular to the longitudinal axis 270. The projection 428 is located inward of the interface between the rounded surface 424 and the end face 426, forming the end face 426 in a generally annular shape around the projection 428. Preferably, the projection 428 encompasses approximately between 50% and 75% of the surface of the end face 426.

Preferably, both the first and second cross-sectional areas A1, A2 are circular, although those skilled in the art will recognize that the first and second cross-sectional areas A1, A2 can be other shapes as well. This configuration reduces the mass of the needle 40 while retaining a relatively large sealing diameter of the valve contact face 422 so as to provide a relatively generous sealing area of the needle 40 for engagement of the valve contact face 422 when the needle 40 is in the closed position. The increased cross-sectional area A2 of the needle 40 acts as a larger bearing surface during operation of the needle 40, thereby improving the wear resistance of the internal surface of the central needle guide opening 282. The improved wear resistance of the internal surface of the central needle guide opening 282 is due to reduced loading compared to that of a conventional base valve guide diameter which was used with prior art needles of a generally constant cross-sectional area. For example, a typical prior art needle will have a substantially continuous cylindrically shaped shaft which terminates at an end portion wherein the cross-sectional area at the upper portion of the needle may be twice as much as the cross-sectional area A2 of the needle 40 shown in FIG. 2. A drawback to the larger cross-sectional area A2 is that a larger sealing diameter between the valve seat 30 and the needle 40 is required, forming a larger sac 60.

The needle 40 is reciprocable between the closed position (shown in FIGS. 2, 2A) and the open position (shown in FIG. 3). When the needle 40 is in the open position, a generally annular channel 430 is formed between the valve contact face 422 and the valve sealing surface 330.

The metering orifice 50 is located within the valve body chamber 262 and is connected to the body 20, downstream of the valve seat 30. The metering orifice 50 has an interior face 510 facing the valve seat 30 and the needle 40, and an exterior face 520 facing the combustion chamber (not shown). A plane of the metering orifice 50 is generally parallel to the plane of the planar end face 426. A virtual extension 340 of the valve seat 30 can be projected onto the metering orifice 50 so as to intercept the interior face 510 of the metering orifice 50 at a point "A", shown in FIG. 2A.

Still referring to FIG. 2A, the metering orifice 50 has a plurality of metering openings 530 radially spaced from the longitudinal axis 270. Preferably, the metering orifice 50 includes between four and twelve metering openings 530 which are symmetrically spaced around the longitudinal axis 270. More preferably, the metering orifice 50 includes eight metering openings 530 as shown in FIG. 4. Preferably, each metering opening 530 is generally circular and is approximately 200 microns in diameter. Preferably, a distance between adjacent metering openings 530 is at least two and a half times as great as a diameter of the metering openings 530, although those skilled in the art will recognize that the distance between adjacent metering openings 530 can be less than that amount. An advantage to the larger cross-sectional area A2 of the needle 40 is that the interior face 510 has a larger surface area which can contain a relatively large number of metering openings 530, and yet maintain a desired separation distance between adjacent metering openings 530.

Preferably, the metering openings 530 each have a longitudinal opening axis 532 which extends generally oblique to the longitudinal axis 270 of the body 20, preferably downward and outward from the longitudinal axis 270. However, those skilled in the art will recognize that the longitudinal opening axes 532 can extend at other angles relative to the longitudinal axis 270. As illustrated in FIG. 4, the metering openings 530 are sufficiently far from the longitudinal axis 270 such that a virtual circle formed by the virtual extension 340 of the valve seat 30 onto the interior face 510 of the metering orifice 50 at "A" has a smaller diameter than a virtual circle 534 drawn around an outer perimeter of the metering openings 530. This ensures that the flow of fuel between the valve seat 30 and the needle 40 when the needle 40 is in the open position directs the fuel onto the metering orifice 50 to provide a transverse flow of the fuel across the metering orifice 50 to the metering openings 530 prior to the fuel entering the metering openings 530. Preferably, the outer perimeter of the projection 428 lies within the virtual circle 534 of the metering openings 530, although those skilled in the art will recognize that the outer perimeter of the projection 428 can lie partially or totally outside of the virtual circle 534 of the orifice openings 530 as well.

With the needle 40 in a closed position, as shown in FIGS. 2, 2A, the end face 426, the interior face 510 of the metering orifice 50 and the valve seat orifice 320 between the downstream side of the needle contact face 422 and the metering orifice 50 form the sac 60. The projection 428 extends from the end face 426 into the sac 60, reducing the volume of the sac 60. Preferably, the projection 428 reduces the volume of the sac 60 between approximately 25% and 75% as compared to a needle 40 without the projection 428.

Still referring to FIGS. 2, 2A, when the needle 40 is in the closed position, the end face 42 extends proximate to the interior face 510 of the metering orifice 50, but allows a gap therebetween. Preferably, the gap is between approximately 50 microns and 250 microns, and more preferably, approximately 50 and 100 microns, although those skilled in the art will recognize that the gap can be other sizes as well. Further, the projection 428 extends proximate to the interior face 510 of the metering orifice 50, but allows a minimum of a 50 micron gap therebetween.

The operation of the injector 10 is as follows. Pressurized fuel flow into the injector 10 is provided by a fuel pump (not shown). The pressurized fuel enters the injector 10 and passes through a fuel filter (not shown) to the armature 240, and to the valve body chamber 262. The fuel flows through the valve body chamber 262, the fuel flow openings 284 in the guide 280 to the interface between the valve contact face 422 and the valve sealing surface 330. In the closed position (shown in FIGS. 2, 2A), the needle 40 is biased against the valve seat 30 so that the valve contact face 422 sealingly engages the valve sealing surface 330, preventing flow of fuel through the metering orifice 50.

In the open position (shown in FIG. 3), a solenoid or other actuating device, (not shown) reciprocates the needle 40 to an open position, removing the valve contact face 422 of the needle 40 from the sealing surface 330 of the valve seat 30 and forming the generally annular channel 430. Movement of the valve contact face 422 of the needle 40 from the sealing surface 330 of the valve seat 30 also enlarges the volume of the sac 60. Pressurized fuel within the valve body chamber 262 flows past the generally annular channel 430 formed by the needle 40 and the valve seat 30, and into the sac 60 where the fuel impacts on the interior face 510 of the metering orifice 50. The end of the channel 430 and the metering orifice 50 are relatively close together to maintain fuel flow velocity. Since, as shown in FIG. 2A, the relative angle between the sealing surface 330 and the interior face 510 of the metering orifice is relatively slight, the fuel flow is only slightly affected and the fuel maintains a relatively high velocity without generating unwanted turbulence.

The fuel then flows across the interior face 510 of the metering orifice 50 generally transverse to the fuel metering openings 530. The fuel turns into the fuel metering openings 530 where the fuel is atomized as it passes through the fuel metering openings 530 to the combustion chamber (not shown) for combustion, allowing for better combustion within the combustion chamber.

When a pre-determined amount of fuel has been injected into the combustion chamber, the solenoid or other actuating device disengages, allowing the spring (not shown) to bias the needle 40 to the closed position, closing the generally annular channel 430 and seating the valve contact face 422 of the needle 40 onto the sealing surface 330 of the valve seat 30. The projection 428 extends toward the end face 426, reducing the volume of the sac 60 and hence, the amount of unmetered fuel within the sac 60.

Figure 5:
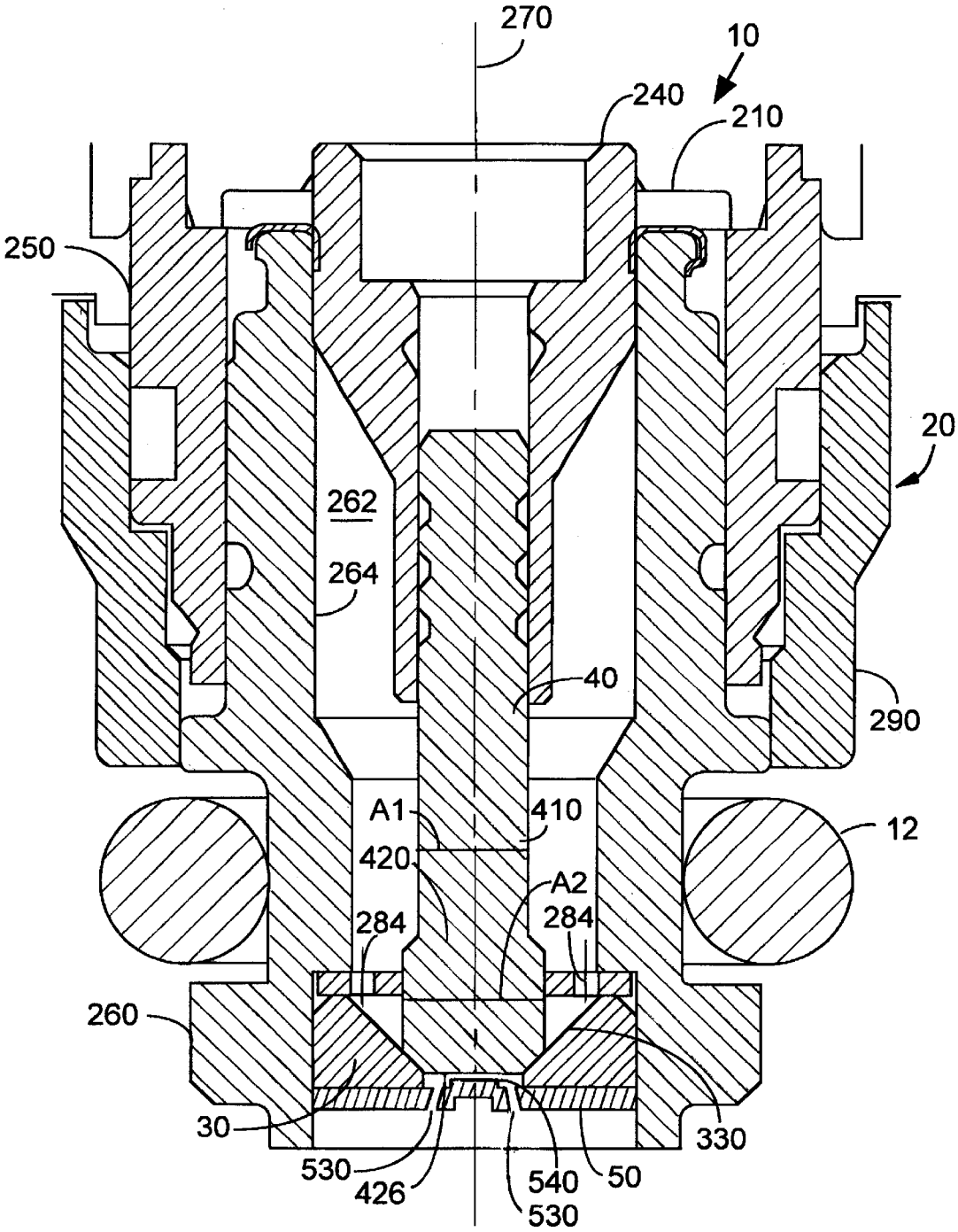
FIG. 5 is a side view, in section, of a discharge end of a fuel injector according to a third embodiment of the present invention.

In a third embodiment, shown in FIG. 5 instead of a projection 428 extending downward from the end face 426 into the sac 60, an orifice projection 540 can extend upward from the interior face 510 of the metering orifice 50 toward the end face 426. Preferably, the orifice projection 540 encompasses approximately between 50% and 75% of the surface area of the planar end face 426. The orifice projection 540 reduces the volume of the sac 60 in a similar manner as the projection 428 as discussed above. Preferably, the gap between orifice projection 540 and the end face 426 when the needle 40 is in a closed position is the same gap (a minimum of 50 microns) as the gap between the projection 428 and the interior face 510 of the metering orifice 50 of the first embodiment when the needle 40 is in the closed position.

Alternatively, although not shown, those skilled in the art will recognize that both the end face 426 and the interior face 510 of the metering orifice 50 can include projections such that each projection reduces the volume of the sac 60 while leaving a gap of preferably a minimum of 50 microns between the projections when the needle 40 is in the closed position.

By reducing the volume of the sac 60 through any of the above described embodiments, the amount of unmetered fuel which is released during low manifold pressure, high injector tip temperature operating conditions will be reduced. Additionally, the reduction in unmetered fuel in the sac 60 will provide improved entry conditions to the metering orifice 50, resulting in improved spray atomization of the fuel through the fuel metering openings 530 and into the combustion chamber (not shown). The reduced amount of unmetered fuel in the sac 60 and the improved spray atomization of the fuel into the fuel chamber will also increase the fuel efficiency of the internal combustion engine.

Preferably, in each of the embodiments described above, the valve seat 30, the needle 40 and the metering orifice 50 are each constructed from stainless steel. However, those skilled in the art will recognize that the valve seat 30, the needle 40 and the metering orifice 50 can be constructed of other, suitable materials.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A fuel injector for use in a fuel injection system of an internal combustion engine, the fuel injector comprising:

a body having an inlet, an outlet and a longitudinal axis extending therethrough;

a valve seat located within the body and disposed proximate the outlet, the valve seat including a valve seat orifice and a sealing surface surrounding the orifice;

a metering orifice connected to the body downstream of the valve seat, the metering orifice includes a plurality of metering openings;

a needle being reciprocally located within the body along the longitudinal axis between a first position wherein the needle is displaced from the valve seat, allowing fuel flow past the needle, and a second position wherein the needle is biased against the valve seat, precluding fuel flow past the needle, the needle including a first portion having a first cross-sectional area and a second portion having a second cross-sectional area, the second cross-sectional area being larger than the first cross-sectional area, the second portion including an end face extending generally perpendicular to the longitudinal axis, the end face being located upstream of the valve seat orifice; and a volume generally defined by the metering orifice, the end face and the valve seat orifice when the needle is in the second position, wherein a first virtual circle defined by a virtual extension of the valve seat onto the metering orifice has a smaller diameter than a second virtual circle defined by the plurality of metering openings.

2. The fuel injector according to claim 1, wherein, when the needle is in the second position, the end face is spaced from the metering orifice by a distance of between 50 microns and 250 microns.

3. The fuel injector according to claim 2, wherein, when the needle is in the second position, the end face is spaced from the metering orifice by a distance of between 50 microns and 100 microns.

4. The fuel injector according to claim 2, wherein the end face is generally planar.

5. The fuel injector according to claim 4, wherein metering orifice is generally planar.

6. The fuel injector according to claim 5, wherein the plane of the metering orifice is generally parallel to the plane of the end face.

7. The fuel injector according to claim 6, further including a projection extending from one of the end face and the metering orifice toward the other of the end face and the metering orifice.

8. The fuel injector according to claim 7, wherein, when the needle is in the second position, the projection is spaced from the other of the end face and the metering orifice by a distance of at least 50 microns.

9. The fuel injector according to claim 1, wherein the sealing surface is oblique to the longitudinal axis.

10. The fuel injector according to claim 1, wherein the valve seat orifice is formed by a generally cylindrical wall.

11. The fuel injector according to claim 1, wherein the projection encompasses approximately between 50% and 75% of a surface area of the one of the planar end face and the metering orifice.

12. The fuel injector according to claim 1, wherein the second portion of the needle engages the valve seat in a generally annular area of contact when the needle is in the second position.

13. The fuel injector according to claim 1, wherein a distance between adjacent metering holes is at least two and a half times a diameter of each of the metering holes.

14. A fuel injector for use in a fuel injection system of an internal combustion engine, the fuel injector comprising:

a body having an inlet, an outlet and a longitudinal axis extending therethrough;

a valve seat located within the body and disposed proximate the outlet, the valve seat including a valve seat orifice and a sealing surface surrounding the valve seat orifice;

a metering orifice connected to the body downstream of the valve seat;

a needle being reciprocally located within the body along the longitudinal axis between a first position wherein the needle is displaced from the valve seat, allowing fuel flow past the needle, and a second position wherein the needle is biased against the valve seat, precluding fuel flow past the needle, the needle including a first portion having a first cross-sectional area and a second portion having a second cross-sectional area, the second portion including an end face extending generally perpendicular to the longitudinal axis; and a volume generally defined by the metering orifice, the end face and the valve seat orifice when the needle is in the second position, the metering orifice being spaced from the end face by a distance of between 100 microns and 250 microns.

15. The fuel injector according to claim 14, wherein the second cross-sectional area is larger than the first cross-sectional area.

16. The fuel injector according to claim 14, wherein the metering orifice includes a plurality of metering openings.

17. The fuel injector according to claim 16, wherein each of the plurality of metering openings has a longitudinal opening axis extending generally oblique to the longitudinal axis of the valve body.

18. The fuel injector according to claim 16, wherein fuel flow across the metering plate is generally transverse to each of the plurality of metering openings.

19. The fuel injector according to claim 14, further including a projection extending from one of the end face and the metering orifice toward the other of the end face and the metering orifice.

20. The fuel injector according to claim 19, wherein the projection is located between the metering openings.

21. The fuel injector according to claim 14, wherein a distance between adjacent metering holes is at least two and a half times a diameter of each of the metering holes.

22. A fuel injector for use in a fuel injection system of an internal combustion engine, the fuel injector comprising:

a body having an inlet, an outlet and a longitudinal axis extending therethrough;

a valve seat located within the body and disposed proximate the outlet, the valve seat including a valve seat orifice and a sealing surface surrounding the valve seat orifice;

a metering orifice connected to the body downstream of the valve seat, the metering orifice includes a plurality of metering openings;

a needle being reciprocally located within the body along the longitudinal axis between a first position wherein the needle is displaced from the valve seat, allowing fuel flow past the needle, and a second position wherein the needle is biased against the valve seat, precluding fuel flow past the needle, the needle including a first portion having a first cross-sectional area and a second portion having a second cross-sectional area, the second portion including an end face extending generally perpendicular to the longitudinal axis; and a volume generally defined by the metering orifice, the end face and the valve seat orifice when the needle is in the second position, the metering orifice being spaced from the end face by a distance of between 100 microns and 250 microns, wherein a first virtual circle defined by a virtual extension of the valve seat onto the metering orifice has a smaller diameter than a second virtual circle defined by the plurality of metering openings.

23. A method of reducing a sac volume in a fuel injector, the fuel injector including a valve seat having an orifice, a needle having an end face, a metering orifice having a plurality of metering openings, and a sac volume located between the end face and the metering orifice, the method comprising:

providing a fuel injector;

providing pressurized fuel to the fuel injector;

opening the fuel injector by removing the needle from the valve seat and enlarging the sac volume, thereby allowing the pressurized fuel to flow past the needle and the valve seat and through the sac volume and the metering orifice for ejection from the fuel injector; and closing the fuel injector by seating the needle against the valve seat, the end face being located upstream of the metering orifice, reducing the sac volume and an amount of fuel within the sac volume, wherein a first virtual circle defined by a virtual extension of the valve seat onto the metering orifice has a smaller diameter that a second virtual circle defined by the plurality of metering openings.

24. A method of reducing a sac volume in a fuel injector, the fuel injector including a valve seat having an orifice, a needle having an end face, a metering orifice, and a sac volume located between the end face and the metering orifice, the method comprising:

providing a fuel injector;

providing pressurized fuel to the fuel injector;

opening the fuel injector by removing the needle from the valve seat and enlarging the sac volume, thereby allowing the pressurized fuel to flow past the needle and the valve seat and through the sac volume and the metering orifice for ejection from the fuel injector; and closing the fuel injector by seating the needle against the valve seat, the end face being located upstream of the metering orifice, reducing the sac volume and an amount of fuel within the sac volume, wherein, after completing the step of closing the fuel injector, a distance between the needle and the metering orifice is between 50 microns and 250 microns.

25. The method according to claim 24, wherein the needle further includes a projection extending therefrom toward the metering orifice, the projection extending into the volume during the step of closing the fuel injector.

* * * * *